US006487985B1

(12) United States Patent
Kuhlman

(10) Patent No.: US 6,487,985 B1
(45) Date of Patent: Dec. 3, 2002

(54) TUG AND BARGE CONNECTOR AND RECEIVER APPARATUS

(76) Inventor: Clare J. Kuhlman, P.O. Box 9055, Kansas City, MO (US) 64168

( * ) Notice: Subject to any disclaimer, the term of this patent is extended or adjusted under 35 U.S.C. 154(b) by 0 days.

(21) Appl. No.: 09/929,403

(22) Filed: Aug. 14, 2001

(51) Int. Cl.[7] ..... B63B 21/56
(52) U.S. Cl. ..... 114/248; 114/250
(58) Field of Search ..... 114/248, 249, 114/250

(56) References Cited

U.S. PATENT DOCUMENTS 3,903,825 A * 9/1975 Hamy ..... 114/249
3,935,831 A * 2/1976 Yamaguchi ..... 114/248
5,050,522 A * 9/1991 Yamaguchi et al. ..... 114/248

* cited by examiner

*Primary Examiner*—Jesus D. Sotelo
(74) *Attorney, Agent, or Firm*—Spencer Fane Britt & Browne LLP

(57) ABSTRACT

An connection apparatus is provided for connecting a ram of a pusher vessel with a receiver installed in a stem notch of a barge, the connection head for mounting on the ram having a generally pentagonal shape and the receiver having two opposed side walls with one side wall being flat and the other side wall having projecting teeth.

11 Claims, 3 Drawing Sheets

TUG AND BARGE CONNECTOR AND RECEIVER APPARATUS

FIELD OF THE INVENTION

The present invention relates to the field of marine equipment, more specifically the present invention relates to the art of connecting tugboats or pusher boats with barges or other non-powered vessels which are equipped with a notch in the stem of the barge for receiving a tug or pusher boat therein.

BACKGROUND OF THE INVENTION

The present invention generally relates to apparatus and methods for connecting tug boats or pusher boats to barges for transporting cargo on oceans, rivers, lakes and harbors. Barges, typically having no drive mechanism, rely upon tugboats or pusher boats to move the barge from one location to another. The connections between tugboats and barges have taken numerous forms over the years. The majority of forms involve interconnection between the tugboat and the barge by use of cables. Alternatively, the use of extendable ram devices on the tug which interconnect with receivers on the barge have been used to achieve a more stable connection.

An example of this extendable ram and receiver configuration is shown in FIGS. 1 and 2 wherein a tugboat or pusher boat 14 is connected to a barge 10. This connection is achieved by the bow of tug 14 entering a generally U-shaped or V-shaped notch 12 on barge 10. Once tug or pusher boat 14 is within notch 12, rams 16 are extended from tug 14 into receivers 18 of the barge. The rams typically have a hydraulic drive or screw drive mechanism and generate sufficient force to securely hold tug 14 within notch 12 of barge 10.

Referring now to FIG. 1, tug 14 is shown joined to barge 10 with rams 16 aligned and extended into receiver 18. It will be appreciated that in FIG. 1 that receiver 18 of barge 10 extends vertically throughout nearly the entire height of barge 10. The reason for this full height receiver is that as barge 10 is loaded or unloaded, its position with respect to waterline 20 will change. Therefore, tug 14 must be able to join with barge 10 at any position along the vertical height of barge 10. This is accomplished by having receiver 18 extend vertically along the entire height of the barge to account for changes in draft of the barge resulting from changes in the waterline 20 position with respect to the barge as a result of loading and unloading of the barge.

In the prior art, an early form of connecting a tugboat with a barge is shown in U.S. Pat. No. 3,512,495 to Fletcher in which a hydraulically extendable pin is mounted on the port and starboard sides of the bow of the tug, and the cylindrical pin of the tug is inserted into a circular receiver or housing mounted on the barge. An alternative form of coupler and receiver is found in U.S. Pat. Nos. 3,844,245 and 3,935,831 to Yamaguchi. In the Yamaguchi device the hydraulic ram mounted on the tug boat is equipped with a generally diamond shaped head or connector in which the top and bottom points of the diamond are truncated or rounded off. The left and right side points of the diamond headed connector of Yamaguchi fit into a receiver mounted on the barge which is equipped with projecting teeth that present indents therebetween. The indents are sized to receive the left and right side diamond head points of tug of mounted ram of Yamaguchi. Yet another alternative form of connecting tug boats with barges is shown in U.S. Pat. No. 4,688,507 to Kuhlman, et al. In the Kuhlman patent, the barge receiver portion is a vertical receiver or channel having spaced apart projecting teeth on either side of the receiver or channel. Into the receiver of the barge is fitted a connector, sometimes referred to as the ram head or helmet, which is mounted on the ram of the tug. The tug ram connector is equipped with three projecting teeth on the left and right side of the connector which intermesh with the teeth on the sides of the channel or receiver on the barge.

While each of these prior-art designs serves to connect a tug boat with a barge, each requires a substantial degree of alignment between the head of the tug ram and the receiver of the barge for an effective, secure connection to be made between the two devices. In the Yamaguchi design, the two opposed diamond points of the ram head must be aligned with the indented spaces between the projecting teeth of the receiver. In the Kuhlman design, the three projecting teeth on either side of the ram head must be aligned with the teeth and depressions of the barge receiver for successful connection. In either of these designs, a certain degree of realignment of the ram head is required of the tug boat operator to successfully complete the connection between the tug and the barge.

In the connection utilized in the Fletcher patent—a cylinder fitted into a circular receiver—a degree of undesirable play between the ram and receiver of Fletcher results since the size of the ram is less than the diameter of the receiving hole or void, there is play between the Fletcher ram and receiving void. Further, the Fletcher ram does not outwardly compress against a solid wall of the barge. Rather, the cylindrical ram is simply inserted into the hole. In Fletcher there is not a snug, lateral connection between the tug and the barge as is provided by the compressive fit of both Yamaguchi and Kuhlman.

OBJECTS AND ADVANTAGES OF THE INVENTION

The present invention achieves two principal advantages over the prior art: (1) a lesser degree of pre-connection alignment is required between the connector or ram head and the barge receiver of the present invention due to the pentagonal configuration of the connector and corresponding configuration of the receiver; and (2) the secure compressive fit between the port and starboard rams of the tug and the port and starboard receivers of the barge is achieved by the inwardly angled connector and receiver design which continues the compressive fit functions of Kuhlman and Yamaguchi while simplifying the equipment needed to achieve re-alignment of the connector prior to its engagement with the receiver.

SUMMARY OF THE INVENTION

These advantages and more are achieved by the connector or ram head and receiver of the present invention which comprise a ram connector that is mateable with the receiver of the barge, the ram connector having a generally pentagonal shape as viewed from the side elevation of the ram connector as it is presented to the receiver. The receiver of the present invention is adapted to mate with the generally pentagonal ram connector by having a configuration which comprises opposed side walls that are spaced apart to receive the generally pentagonal shaped ram connector therein. One of the side walls has a generally flat surface, and the opposed side wall has vertically spaced apart teeth or projections. In the space between two adjacent projections is received one of the edges or corners of the pentagonally shaped ram connector of the tug. The flat face of the pentagonally shaped connector which is opposite the connector edge that is captured between the projecting teeth is fitted against a flat receiver sidewall that is opposite the receiver sidewall having the teeth or projections thereon.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DESCRIPTION OF THE PREFERRED EMBODIMENT

As required, detailed embodiments of the present inventions are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
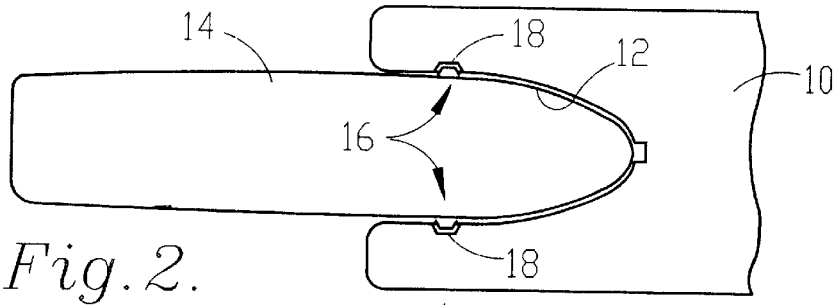
Fig. 2. (Prior Art)
FIG. 2 is a plan view of a tug interconnected with a barge by insertion of the tug within the notch of the barge and showing the orientation of the rams on a tug within the receivers of the barge.
Figure 3:
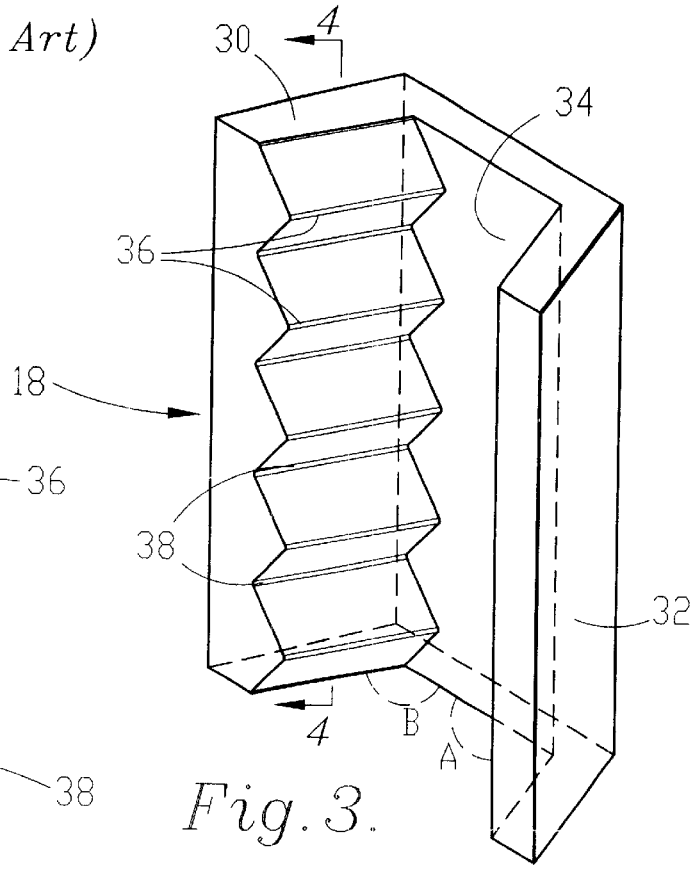
FIG. 3 is a front and right side perspective view of a portion of the receiver.
Figure 6:
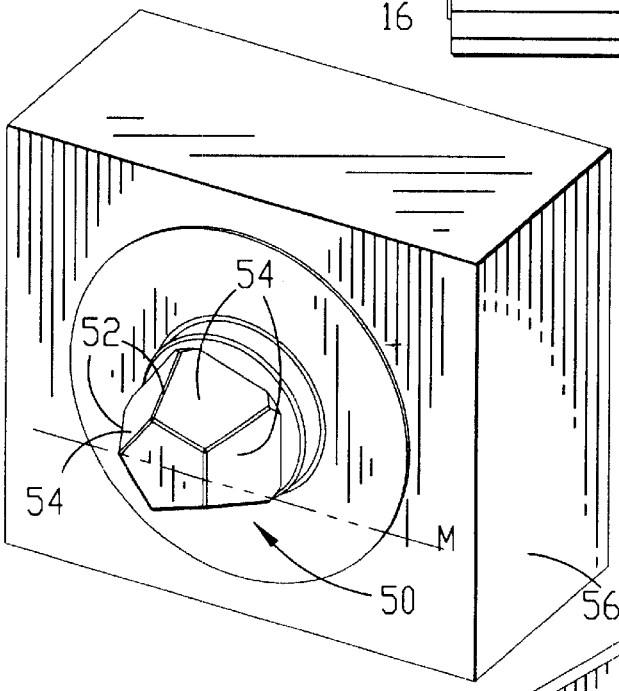
FIG. 6 is a front and right side perspective view of a fragmentary portion of the tug hull showing the exterior of the tug hull with the connector head of the ram extending therefrom.

The present invention includes a receiver portion for mounting on a barge and a connector portion for mounting on the ram of a tug. These two individual components are designed to cooperate to connect the tug with the barge. Referring now to FIG. 3, receiver 18 is mounted on either side of notch 12 (FIG. 2) of barge 10 (FIG. 2) in similar fashion to the mounting of the prior art receivers on barges. Receiver 18 is comprised of a first sidewall 30 and a second sidewall 32 which are connected by a rear wall 34. First sidewall 30 is further comprised of a plurality of peaks or projecting teeth 36 which are spaced apart by intervening valleys or troughs 38. Opposing sidewall 32 is a generally flat surface which does not contain the projecting teeth 36 or troughs 38 of sidewall 30. The two opposed sidewalls are interconnected by rear wall 34. Rear wall 34 can be integrally formed with opposed sidewalls 30, 32, or rear wall 34 can be an existing portion of barge 10. The angle formed by second sidewall 32 and rear wall 34, angle A, is approximately 112 degrees. The angle formed by rear wall 34 and first sidewall 30, angle B, is approximately 116 degrees. This angle of opening in receiver 18 is designed to accept a generally pentagonally shaped connector 50 (FIG. 6).

Still referring to FIG. 3, it will be appreciated by those skilled in the art that receiver 18 is best configured as a single piece with rear wall 34, sidewalls 30 and 32 formed as an integral unit. Typically, receiver 18 will be formed as a steel casting or steel fabrication which is subsequently integrated with barge 10 (FIG. 2). When formed as a single unit receiver 18 is better able to withstand the forces placed against it by the connector 50 (FIG. 6).

Figure 4:
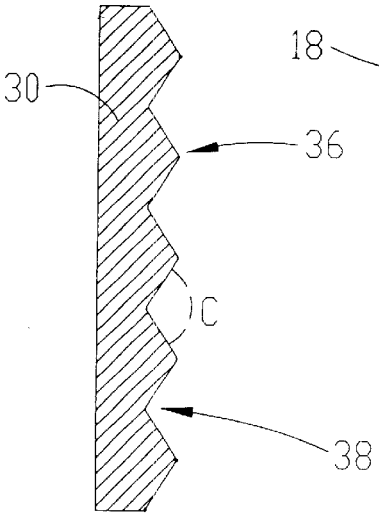
FIG. 4 is a fragmentary cross-sectional view taken along line 4—4 of FIG. 3 and showing the projecting teeth and troughs therebetween.
Figure 9:
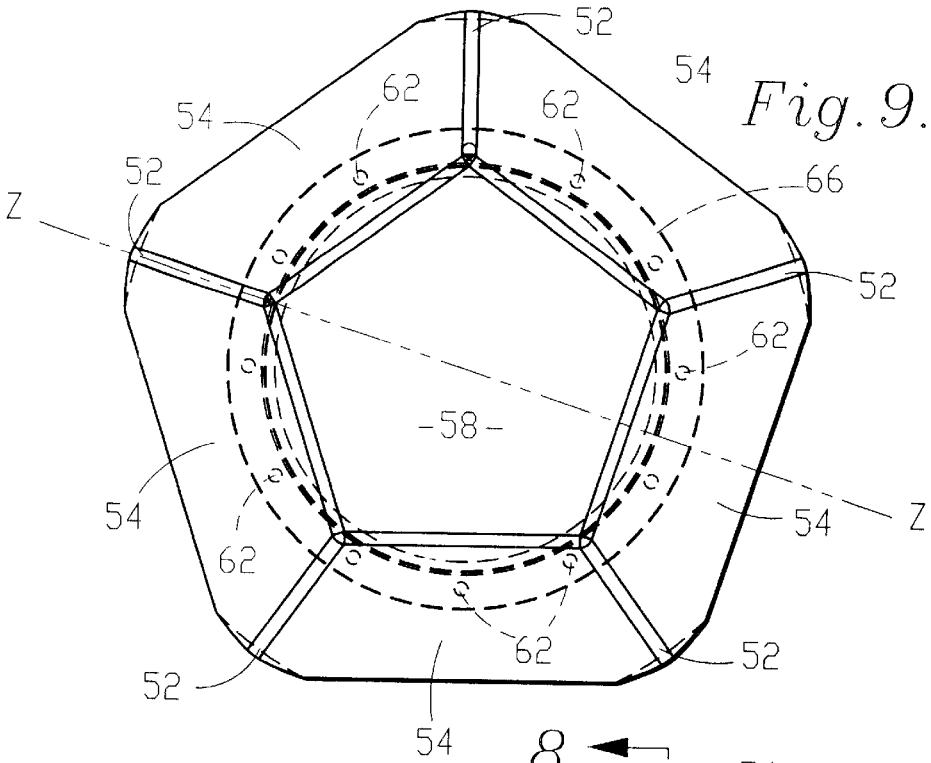
FIG. 9 is an elevation view of the connector and showing in phantom lines the securing collar in place at the rear of the connector.
Figure 10:
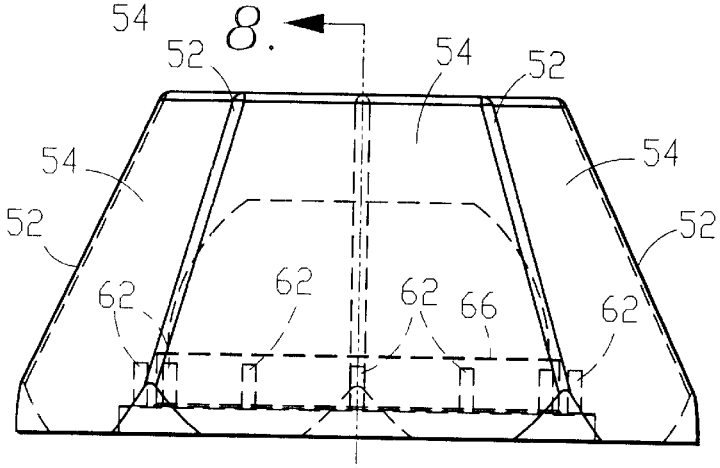
FIG. 10 is a side elevation of the connector and showing the ram mounting ball in phantom lines.

Referring now to FIG. 4, teeth or projections 36 and spaces or troughs 38 of receiver 18 will be discussed. First sidewall 30 of receiver 18 is equipped with projecting teeth 36 which are spaced apart by intervening troughs 38. The angle between teeth 36, angle C, is approximately 108 degrees and is designed to allow capture within the adjacent trough 38 of two teeth 36 an edge 52 of connector 50. Edge 52 being formed by the junction of two faces 54 of pentagonal connector 50(FIG. 9). As the angle formed between any two faces 54 of pentagonally-shaped connector 50 is approximately 108 degrees, angle C (FIG. 4) of receiver 18 has been sized to receive that angle.

Figure 5:
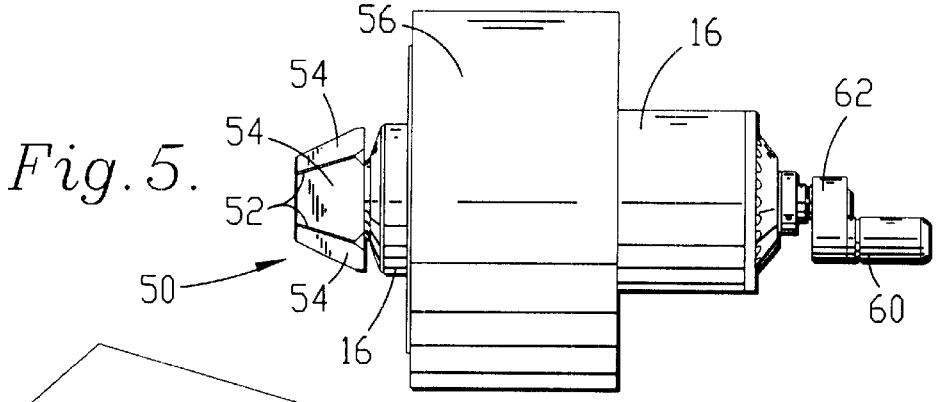
FIG. 5 is a side elevation view of a ram mounted in a fragmentary cross-section of the hull of a tug and showing the connector of the ram extending on the outer side of the hull.

Referring now to FIG. 5, connector 50 is mounted on that portion of ram 16 which extends from the outer side of tug hull wall 56. The bulk of ram 16 is contained within the interior hull of the tug or pusher boat and extends through tug hull sidewall 56 to present ram 16 with connector 50 mounted thereon to the environment. It will be appreciated, as fully described in U.S. Pat. No. 4,688,507 which is incorporated herein by reference, that energizing motor 60 transmits rotational power through gear box 62 to rotate an internal screw drive within ram 16. In one direction the screw drive extends connector 50 away from tug hull 56 and, in the reverse direction, the screw drive retracts connector 50 toward tug hull 56. It is through the extension and retraction of connector 50 that the connection and disconnection between barge 10 and tug boat 14 is accomplished. Specifically, and now referring to FIG. 7, connector 50 is shown extended into receiver 18 of barge 10 to securely hold tug 14 within notch 12 of barge 10.

Referring now to FIGS. 6 and 9, connector 50 which is designed to mate with receiver 18 of FIG. 3 will be discussed. FIG. 9 shows an elevation view of connector 50.

Connector 50 is generally in the shape of a pentagon as viewed from the barge-mounted receiver. Each face 54 of pentagonal connector 50 extends outwardly from the front, flat face 58 of connector 50 at an angle of approximately 112 degrees. This angle of faces 54 of connector 50 provides an outwardly angled connector which fits closely within receiver 18. The pentagonal shape of connector 50 allows any of faces 54 to closely fit against side 32 of receiver 18, side 32 having a flat face. Each of edges 52 of connector 50 form an angle which is receivable within any of troughs 38 of receiver 18. Still referring to FIG. 9, it will be appreciated by those skilled in the art and by examination of line Z drawn through connector 50, that each and every edge 52 is opposite the center of a face 54 of connector 50. The result of this geometry is that as connector 50 is extended by ram 16 towards receiver 18 of barge 10, an edge 52 and the opposing face 54 will begin to contact side 30 and side 32 respectively of receiver 18. As an edge 52 begins to enter receiver 18, edge 52 will first contact either a projecting surface close to one of projection 36 or a first contact will be made between a face 54 and sidewall 32 when edge 52 is more proximate to one of troughs 38. In this manner, the presentation of an edge 52 to one side of receiver 18, and a flat surface of face 54 to the other side of receiver 18 provides a generally self-orienting connector 50 which, in most situations, avoids the need for operator reorientation of the connector as has been the case with the prior art devices. In most instances, if connector 50 becomes positioned so face 54 is generally parallel to side wall 30, connector 50 is free to move vertically until the face 54 is approximately centered on edge 36 allowing the connector 50 to rotate resulting in edge 52 entering trough 38 for a correct self-oriented connection.

Figure 7:
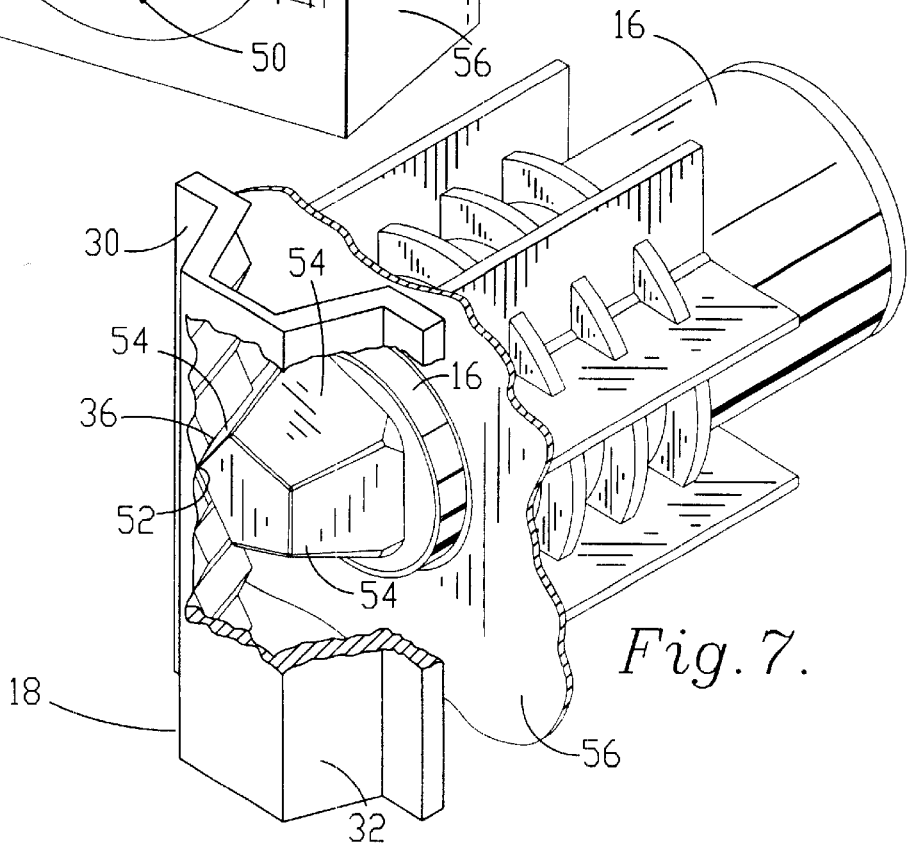
FIG. 7 is a front and right side perspective view of the ram mounted in the tug hull and with the head of the ram connected into the receiver of the barge with a portion of the flat sidewall of the receiver removed.
Figure 8:
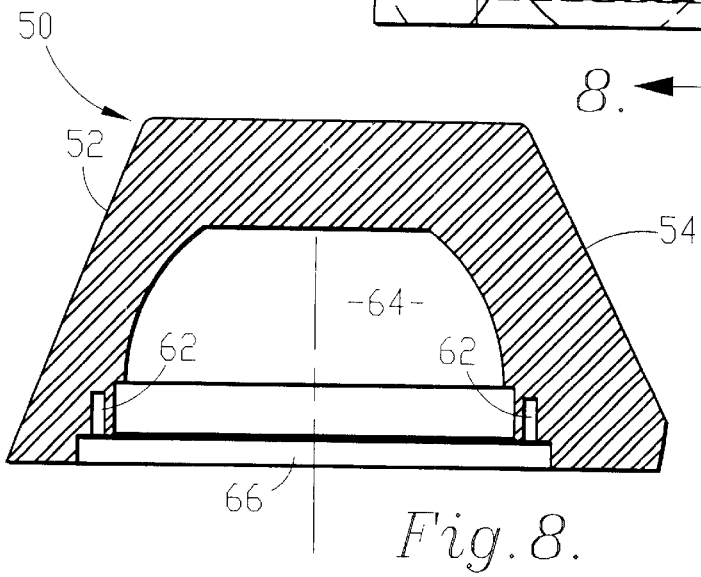
FIG. 8 is a cross-sectional view of the connector taken along line 8—8 of FIG. 10 and showing the connector mounted on the ram.

Referring now FIG. 8, connector 50 is shown in cross-sectional view as seated on the end of ram 16. Edge 52 and opposed face 54 form an angle of approximately 48 degrees with respect to each other. This angle of 48 degrees approximately matches the opening angle between first sidewall 30 and second sidewall 32 of receiver 18. Again referring to FIG. 7, connector 50 is shown inserted into receiver 18 of barge 10. One of the projections 36 of sidewall 30 is shown in phantom lines in position underneath edge 52 of connector 50. Edge 32 of receiver 18 is shown in position to engage face 54 of connector 50 which is opposite the particular edge 52 of connector 50 which is engaged with projection 36.

Figure 1:
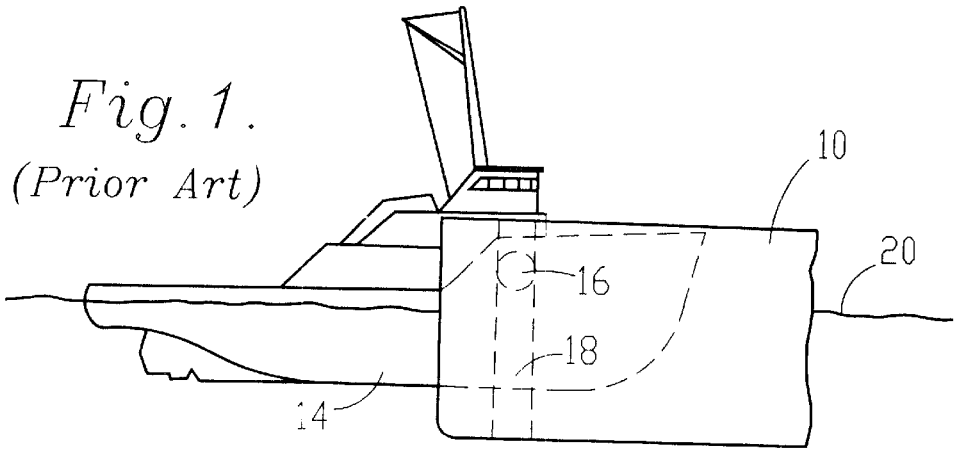
Fig. 1. (Prior Art)
FIG. 1 is a side elevation view of a tug interconnected with a barge.

In operation, receivers 30 are mounted into the sidewalls of a notch 12 in a barge 10 (FIG. 2). Generally, flat wall 32 of both receivers 18 which are mounted on barge 10 will be similarly positioned, that is both flat walls 32 will be forward or both will be aft. A tug 14 having ram 16 mounted therein is equipped with connectors 50 on the support ball 64 of ram 16 (FIG. 8). Support ball 64 is a steel ball and connector 50 is secured thereto by the attachment of two securing plates 66 using threaded voids 62 (FIG. 8). The two securing plates form a collar, as shown in phantom lines in FIG. 9, which retains connector 50 on support ball 64. Support ball 64 acts as a swivel for connector 50 and allows connector 50 to move to allow connector 50 and receiver 18 to self-allign and to account for discontinuities in the construction of either receiver 18 or the connector 50. Again referring to FIGS. 1 and 2, A tug 14 which is outfitted with connectors 50 on ram 16 approaches notch 12 of a barge 10 and aligns itself within notch 12. Once in the notch, the tug operator activates motor 60 of ram 16 (FIG. 7), and ram 16 extends outwardly to engage connector 50 within receiver 18 of barge 10 (FIG. 7). Again, as is shown in FIG. 7, an edge 52 of connector 50 is captured within two vertically adjacent teeth of receiver 18 and a face 54 which is opposite the captured edge 52 abuts against flat sidewall 32 of receiver 18. Referring again to FIG. 6, the orientation of connector 50 as it is captured within receiver 18 of FIG. 7 can be seen with the barge and receiver removed. As previously explained, edge 52 is directly opposite a face 54 as indicated by line M in FIG. 6. The alignment of connector 50 shown in FIG. 6 is similar to the alignment of FIG. 50 shown in FIG. 7 and should assist those skilled in the art in appreciating the relative contact between flat face 54 and flat sidewall 32 on one side of connector 50, and the capture of an edge 52 between two projecting teeth 36 of sidewall 30 of receiver 18.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense. Having now described the features, discoveries and principles of the invention, the manner in which the inventive tugboat and barge connector and receiver combination is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

Having thus described the invention, what is claimed as new and desired to be secured by Letters Patent is as follows:

1. A connector and receiver assembly for coupling a ram of a pusher vessel within a stern notch of a barge, said assembly comprising:

a generally pentagonal connector head attached to the ram, a receiver for said head on the barge said receiver comprising, first and second generally opposed sidewalls attached to the barge;

said first sidewall having a generally flat surface, and said second sidewall having a notched surface.

2. A receiver for mounting on a barge for connecting the barge to a tug, said receiver comprising:

first and second generally opposed sidewalls on the barge;

said first sidewall having a generally flat surface, and said second sidewall having a notched surface.

3. The receiver as claimed in claim 2 wherein said second sidewall notched surface comprises vertically spaced apart projecting teeth.

4. The receiver as claimed in claim 2 further comprising a back wall connecting said sidewalls.

5. The receiver as claimed in claim 4 wherein said back wall connects to said sidewalls at an angle of approximately 108 degrees.

6. A receiver for mounting on a barge for connecting the barge to a tug, said receiver comprising:

first and second generally opposed sidewalls, a back wall connecting said sidewalls, said first sidewall having a generally flat surface, and said second sidewall having a notched surface.

7. The receiver as claimed in claim 6 wherein said second sidewall notched surface comprises vertically spaced apart projecting teeth.

8. A connector head for installation on a ram of a pusher vessel said connector head comprising a generally pentagonal shape.

9. A connector head for a ram of a pusher vessel said connector head comprising:

a first generally flat connector surface, a second connector surface opposed to said first connector surface, said second surface comprising an edge.

10. The connector head as claimed in claim 9 wherein said edge is formed by the junction of two generally flat surfaces.

11. The connector head as claimed in claim 9 wherein said edge is comprised of an outwardly extending flat plate.

* * * * *